US011974622B1

(12) United States Patent
Caveny

(10) Patent No.: US 11,974,622 B1
(45) Date of Patent: May 7, 2024

(54) HAT FORM

(71) Applicant: Timothy N Caveny, Dallas, TX (US)

(72) Inventor: Timothy N Caveny, Dallas, TX (US)

( * ) Notice: Subject to any disclaimer, the term of this patent is extended or adjusted under 35 U.S.C. 154(b) by 0 days.

(21) Appl. No.: 17/691,250

(22) Filed: Mar. 10, 2022

(51) Int. Cl.
*A42B 1/002* (2021.01)
*A47G 25/10* (2006.01)

(52) U.S. Cl.
CPC ..... *A42B 1/002* (2013.01); *A47G 25/10* (2013.01)

(58) Field of Classification Search
CPC .. A42B 1/002; A42C 1/00; A42C 1/02; A42C 1/04; A42C 1/06; A42C 1/08; A42C 2/00; A42C 2/005; A42C 2/007; A42C 3/00; A42C 3/02; A42C 3/04; A42C 3/06; A42C 99/00; A45D 44/14; A47F 7/06; A47F 7/065; A47G 25/10
USPC .... 223/8, 10, 12, 13, 14, 15, 16, 17, 24, 25, 223/26, 84; 211/3, 33; 2/195.5; D2/892
See application file for complete search history.

(56) References Cited

U.S. PATENT DOCUMENTS 292,487 A * 1/1884 Helbig ..... A42B 1/002 2/175.4
340,133 A * 4/1886 Lucey ..... A41H 5/01 223/68
711,253 A * 10/1902 Martin ..... A47F 7/06 211/33
781,592 A * 1/1905 Catino ..... A47F 7/06 211/33
810,421 A * 1/1906 Koehler ..... A47F 7/06 211/33
1,390,372 A * 9/1921 Miller ..... A47G 25/10 211/32
1,787,727 A * 1/1931 Hildreth ..... A42B 1/002 206/9
1,856,921 A * 5/1932 Lowenthal ..... A42B 1/002 223/24
2,418,764 A * 4/1947 Ford ..... A42B 1/002 D2/892
2,713,444 A * 7/1955 Dombrowski ..... A42B 1/002 223/25
3,036,698 A * 5/1962 Gronemeyer ..... B65D 85/18 206/8
3,447,726 A * 6/1969 George ..... A45D 44/14 40/538
3,568,899 A * 3/1971 Rosenberg ..... A45D 44/14 269/95
3,580,436 A * 5/1971 Di Luco ..... A47F 7/065 223/66
3,741,448 A * 6/1973 Friedman ..... A45D 44/14 223/66
4,491,256 A * 1/1985 Payne ..... D06F 59/02 223/24
5,548,846 A * 8/1996 Bianchetti ..... A42B 1/0184 2/209.12

(Continued)

FOREIGN PATENT DOCUMENTS

DE 202012009531 U1 * 11/2013 ..... A47F 7/06
KR 2337524 B1 * 12/2021 ..... A47G 25/10

*Primary Examiner* — Joshua E Rodden
(74) *Attorney, Agent, or Firm* — Jeffrey Roddy

(57) ABSTRACT

A hat retention form includes a base and crown. Joined to the crown in a spoke arrangement are several resilient curved leaves that are each biased to curve away from the base and restrained at their ends under tension by one or more stops each of which functions as a resting surface for a retained hat.

2 Claims, 3 Drawing Sheets

(56) References Cited

U.S. PATENT DOCUMENTS 6,389,603 B1 * 5/2002 Dorantes Perez ..... A42B 1/002
2/171.03

* cited by examiner

HAT FORM

The invention relates to hat retention forms.

BACKGROUND

Hat forms of various kinds are known in the art. Although useful for their intended purpose, typically such forms are made to fit an exact size of hat and designed for long term storage. When not being worn, hats can be damaged by crushing or in some cases, can be carried away by a gust of wind when driving. What is needed is a hat retention form that is readily attachable to vertical and horizontal surfaces such as walls, doors and dashboards.

It would be desirable to provide a hat retention form capable of accommodating a range of hat sizes.

It would be desirable if portions of the foregoing hat retention form were biased to press against the inside (e.g., sweat band) of a retained hat.

It would be even further desirable if the hat retention form were lightweight and portable.

SUMMARY

In a general example implementation of the present invention, a hat retention form includes a crown portion, a base portion, a plurality of resilient leaves, and a plurality of stops.

In an aspect combinable with any other aspect described herein, each resilient leaf is configured to abut a portion of each stop.

In an aspect combinable with any other aspect described herein, each resilient leaf is restrained under tension by a corresponding stop.

In an aspect combinable with any other aspect described herein, each flexible resilient leaf may include a stiffening portion or reinforcement.

In an aspect combinable with any other aspect described herein, a first paired set of the plurality of leaves share substantially the same length.

In an aspect combinable with any other aspect described herein, a second paired set of the plurality of leaves share substantially the same length.

In an aspect combinable with any other aspect described herein, the hat retention form includes a framework producing a fixed curvature along a section of some of the plurality of leaves.

In some implementations, the resilient leaves may include one or more plastics, (e.g., ABS, HDPE, PETE, Urethane) metals, various plastic and metal composites, natural materials (e.g., wood strips) or fiber-filled/wrapped resins.

In some implementations, the plurality of stops function as a resting surface for the under brim of a hat.

In some implementations, the leaf restraining function provided in some implementations may be provided by a spring or elastomeric band.

It should be understood that the features, objects and aspects of any one implementation may be added to or combined with the features, objects or aspects of any other implementation.

BRIEF DESCRIPTION OF THE DRAWING FIGURES

REFERENCE TO THE NUMBERED ELEMENTS

Figure 1:
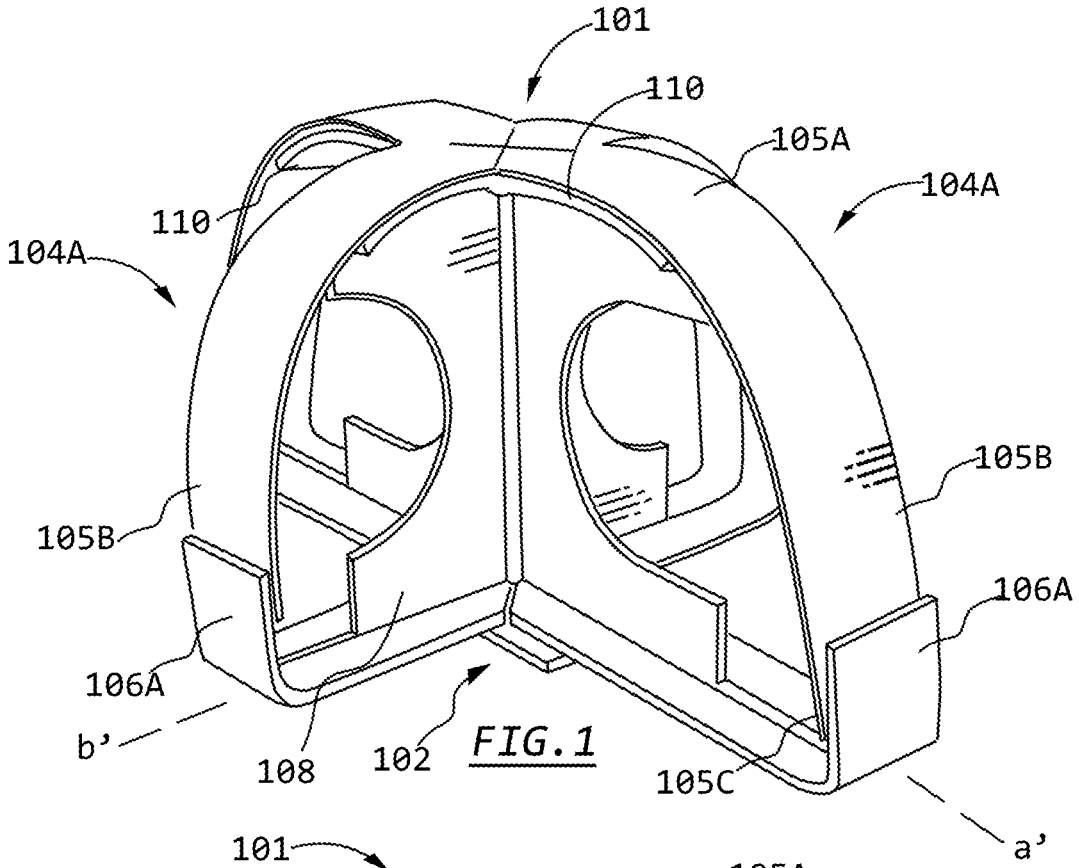
FIG. 1 is a perspective view of an example hat retention form.
Figure 2:
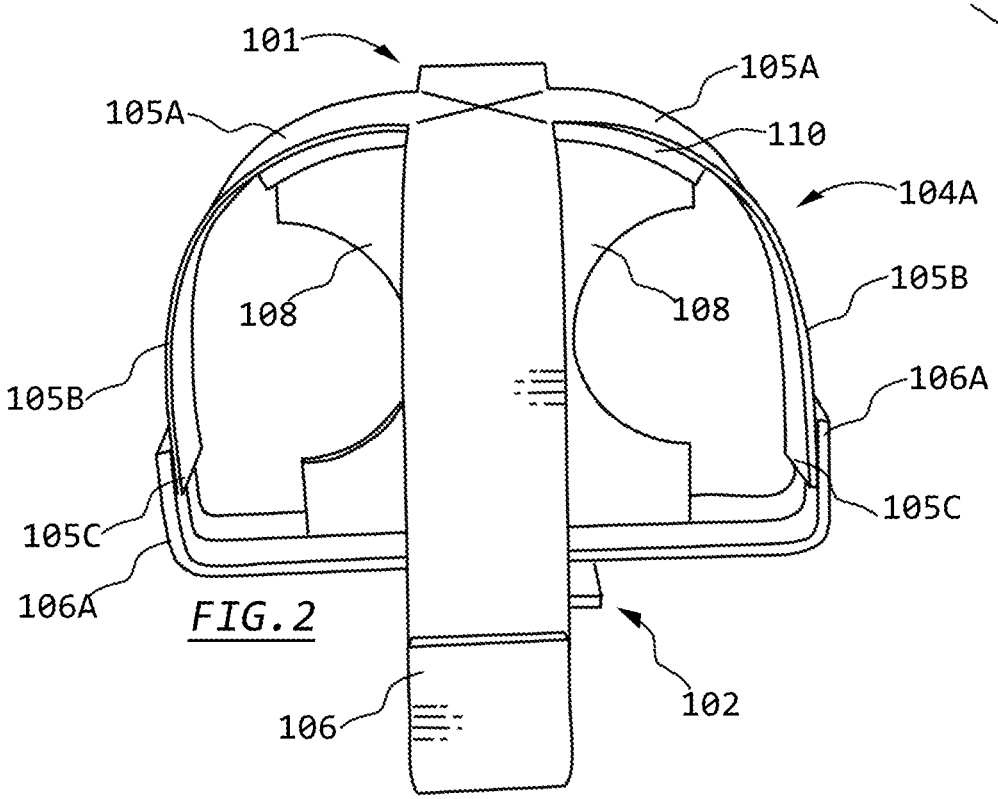
FIG. 2 is front perspective view thereof.
Figure 3:
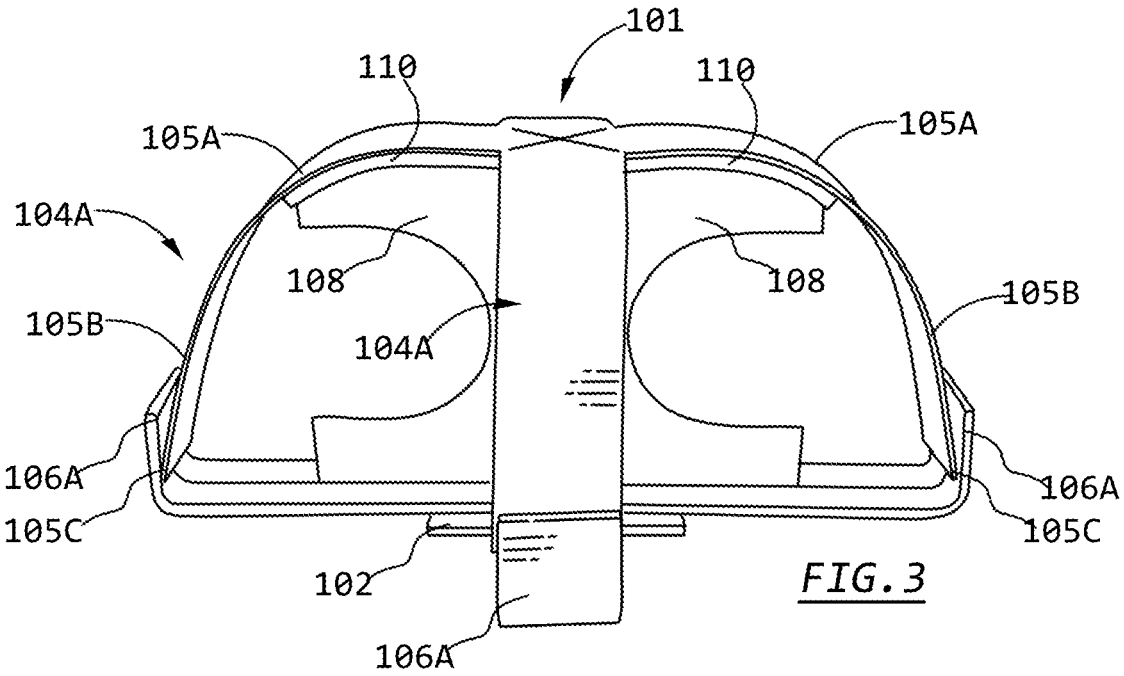
FIG. 3 is a left or right perspective view thereof.
Figure 4:
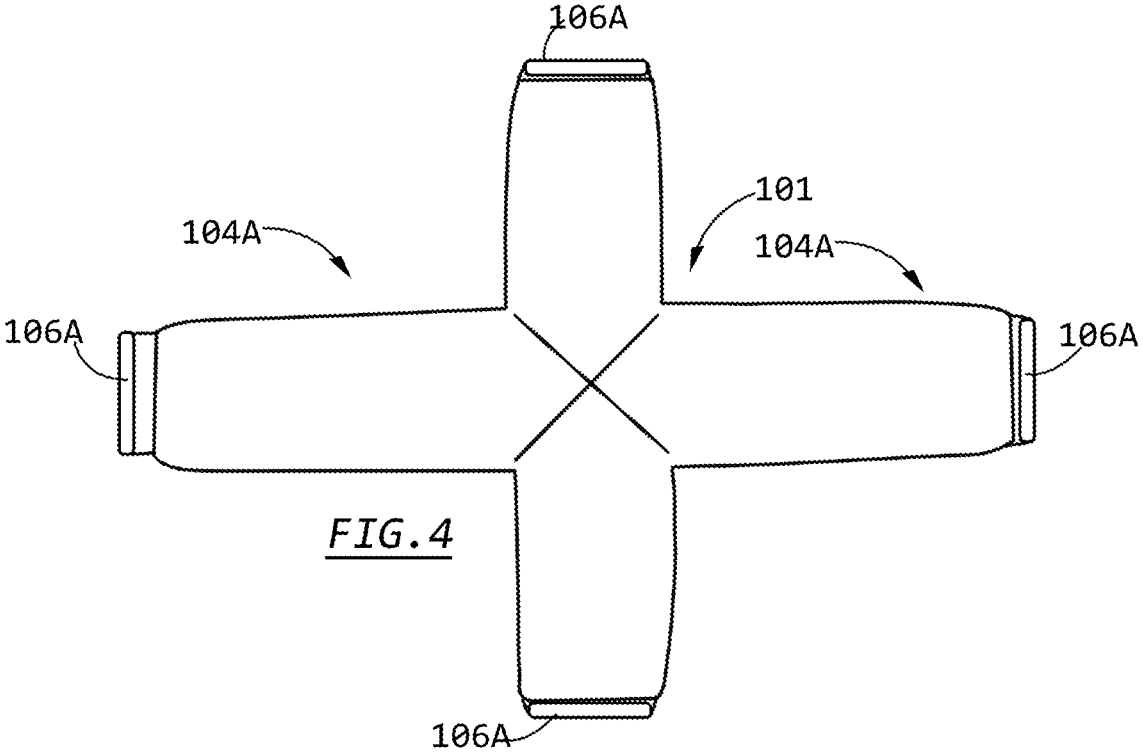
FIG. 4 is a top perspective view thereof.

100 hat retention form
101 crown
102 base
103 adhesive
104A flexible leaf
104B first pair leaves
104C second pair leaves
105A leaf upper portion
105B leaf lower portion
105C leaf lower lip
106A, 106B stop
108 support frame
110 leaf reinforcement
112 band/spring
200 hat
201 under brim
202 sweat band

Definitions

The term "hat" as used herein means any hat or cap of flexible material. The term "leaf" and "leaves" refers to bendable, resilient lengths of a material. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references listed in this disclosure are incorporated by reference in their entirety for all purposes. In case of conflict, the present specification, including explanations of terms, will control. In addition, the materials, methods, and examples are illustrative only and not intended to be limiting.

DETAILED DESCRIPTION OF THE EMBODIMENTS

Figure 5:
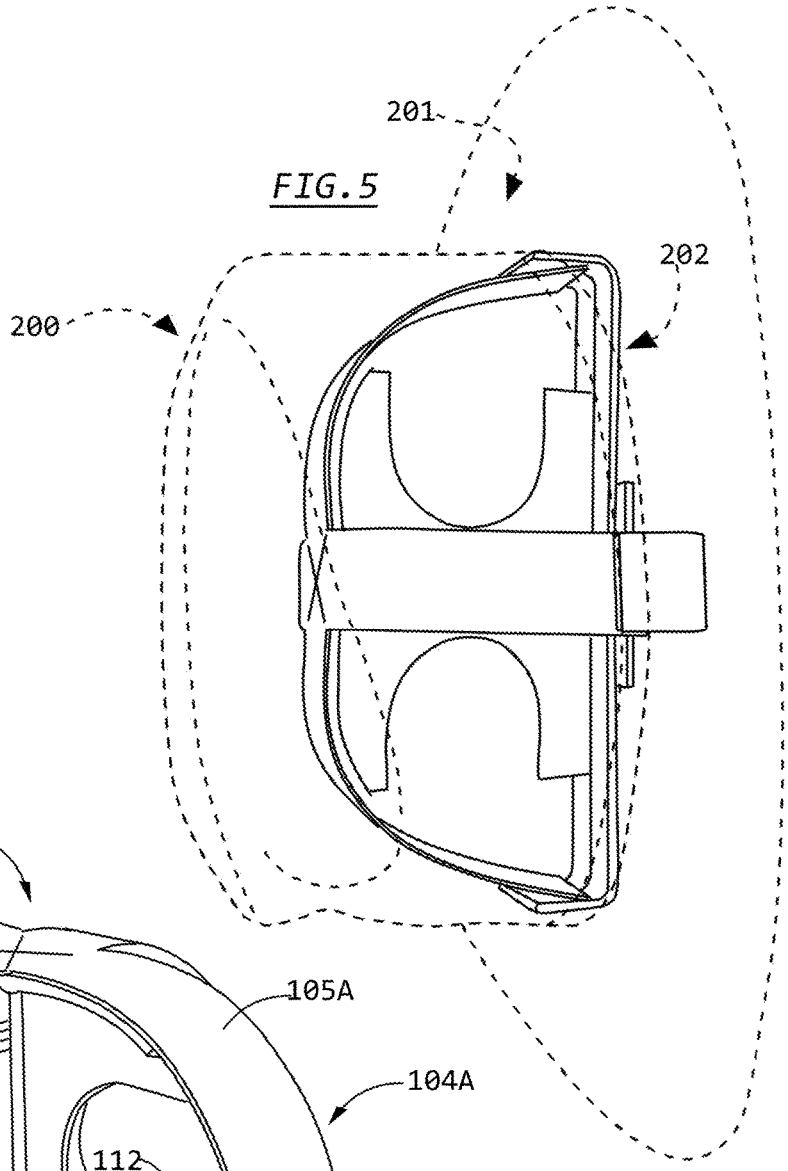
FIG. 5 depicts a typical use thereof.
Figure 6:
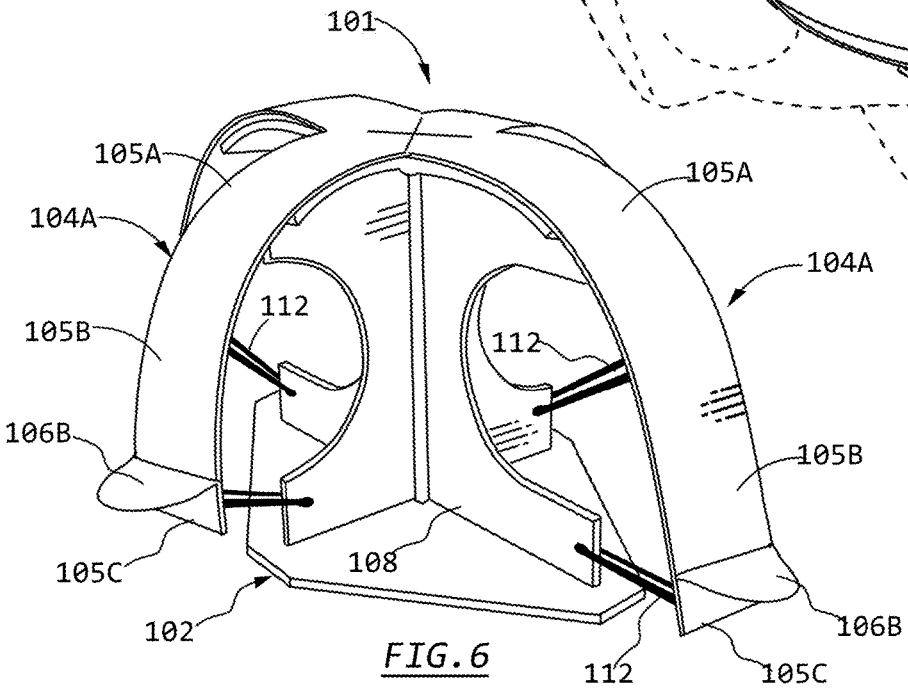
FIG. 6 is a perspective view of another example implementation according to the present invention.

Referring generally to FIGS. 1-6, a hat retention form (100) includes an uppermost portion or crown (101) and a bottom or base portion (102). Between the crown and base portion are a number of resilient leaves, each similar to a leaf spring. Joined to an underside of each leaf (104) is a framework (108). An upper portion (105A) of the leaf follows a fixed curvature defined by the framework. Lower portion (105B) of the leaves (104) when unconstrained are biased to bow outwardly away from the base (102). Constraining the lower portions (105B) of each leaf is a stop (106) engaging a lower lip (105C) of each leaf and blocking each leaf from bowing outwardly away from the base. In the particular implementation depicted in the figures, the retention form has bilateral symmetry, with a first pair of resilient leaves (104B) sharing similar length along a longitudinal axis (a') of the retention form, and a second pair of resilient leaves (104B) sharing a similar length along a transverse axis (b') of the form. It is conceivable that in other implementations, persons having skill in the art will appreciate that the first pair of resilient leaves may be substituted for single relatively longer curved leaf (104) having its opposite terminal ends constrained by a stop at each end, and likewise, the second pair of resilient leaves may be substituted for a single leaf (104) disposed transverse the longer leaf with its opposite terminal ends constrained by a stop at each end. It is also conceivable that instead of the particular implementation shown in (FIGS. 1-5), stops (106) that restrain the ends of the leaves and prevent the curvature of each leaf from assuming a larger radius, may be substituted with a spring or elastomeric band (0034) connected to the back side of each leaf and anchored to a middle post or portion of framework (108), as shown in (FIG. 6).

FIG. 5 shows a typical use wherein hat form (100) has been mounted to a wall surface. Other surfaces may include vehicle dashboards, door surfaces, countertops, etc. Base (102) may be attached to any surface via hook and loop fastener, foam tape, magnets, adhesives or other suitable fastener as would be appreciated by those with skill in the art. In some implementations, base (102) may include two parts, a separable portion joined to the stops and a docking member that remains on a desired surface.

FIG. 6 shows an implementation that employs springs, whether coil, elastomeric band or suitable substitution that would appreciated by those having skill in the art to restrain each leaf to a maximum radius. In any of the various implementations shown, when a hat with a sweatband length or width shorter than that of the maximum distance between opposite leaves (104) will cause the leaves to bend inwardly to match the profile of the hat. Stops (106) provide a resting surface for the hat or cap placed on the form.

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and implementations as would be appreciated by those of ordinary skill in the art having benefit of this disclosure, and falling within the spirit and scope of the following claims.

I claim:

1. A hat retention form comprising:

a crown portion;

a plurality of resilient leaf members, each leaf member of the plurality of leaf members includes a first end connected to the crown portion and a free end biased to curve outwardly a base portion;

a plurality of stop members, each stop member of the plurality of stop members is paired with one of the plurality of resilient leaf members, and each stop member includes a proximal portion connected to the base portion and a distal portion including a terminal flange, each stop member is configured to restrain the free end of each leaf member to a maximum radius but allow the free ends to flexibly assume a reduced radius short of the maximum radius;

a support frame joined to the base portion at a lower end and joined to the crown portion at an upper end;

one or more leaf reinforcement portions, each leaf reinforcement member of the plurality of reinforcement members disposed between the crown portion and the support frame, and the one or more leaf reinforcement portions adapted to reinforce an underside of each leaf member of the plurality of leaf members.

2. The hat retention form according to claim 1, the plurality of resilient members including a first subset of leaf members including a length and a second subset of leaf members including a length and the length of the first subset are less than the length of the second subset.

* * * * *